United States Patent [19]

Rees

[11] Patent Number: 4,607,459

[45] Date of Patent: Aug. 26, 1986

[54] COMBINED HOLLOW GRINDER, SHARPENER AND HONER

[75] Inventor: Spencer C. Rees, Sugar Grove, Ill.

[73] Assignee: Wen Products, Inc., Chicago, Ill.

[21] Appl. No.: 640,158

[22] Filed: Aug. 10, 1984

[51] Int. Cl.[4] ..... B24B 3/00; B24B 27/02

[52] U.S. Cl. ..... 51/102; 51/238 R; 51/240 R; 51/267; 51/285; 248/302; 269/74

[58] Field of Search ..... 51/102, 128, 216 A, 51/238 R, 240 R, 240 A, 262 R, 262 A, 267, 285; 76/82.2, 84; 248/302, 303, 674, 680; 269/74

[56] References Cited

U.S. PATENT DOCUMENTS

| | | | |
|---|---|---|---|
| 144,891 | 11/1873 | Cummings | 51/267 |
| 989,085 | 4/1911 | Turbon | 248/680 |
| 1,063,391 | 6/1913 | Rodgers | 51/285 |
| 1,193,525 | 8/1916 | Dosch | 51/240 A X |
| 1,387,646 | 8/1921 | Hansen | 51/240 A X |
| 1,756,710 | 4/1930 | Tuttle | 51/102 |
| 2,318,764 | 4/1941 | Dorris | 51/128 |
| 2,579,680 | 12/1951 | Leighton | 51/102 |
| 2,722,783 | 3/1953 | O'Russa | 51/102 |
| 3,258,878 | 7/1966 | Clark | 51/102 X |
| 4,259,814 | 4/1981 | Glaser et al. | 51/240 A X |
| 4,388,780 | 6/1983 | Rees | 51/128 |
| 4,423,568 | 1/1984 | Gould | 51/267 X |
| 4,528,778 | 7/1985 | Wolff | 51/285 X |

*Primary Examiner*—Robert P. Olszewski

*Attorney, Agent, or Firm*—Hill, Van Santen, Steadman & Simpson

[57] ABSTRACT

A portable grinder, honer and polishing machine is provided which has a horizontally rotating cylindrical grinding wheel continuously cleaned of swarf and wetted by a porous wiper extending into a liquid reservoir in the grinder housing. A tool rest with a phantom pivot point is pivotally and laterally movable relative to the grinding wheel and carries a tool guide protractor which permits accurate horizontal angular positioning of a tool being sharpened. A scissors blade guide is provided toprecisely sharpen scissors and a retaining leg is pivotable into an operative position to hold the grinder stationary on a work surface. A tool stop is provided on the tool rest to ensure linearity of the sharpened edge on an elongated tool.

22 Claims, 14 Drawing Figures

COMBINED HOLLOW GRINDER, SHARPENER AND HONER

BACKGROUND OF THE INVENTION

1. Field of the Invention

This invention relates to an apparatus for grinding, honing and sharpening metal objects by means of a wet grinding wheel.

2. Description of the prior art

Sharpening metal objects by means of a grinding wheel is generally known in the art. It is also known in the art to provide water or other liquid such as oil to a grinding stone to aid in the grinding, sharpening or polishing of the metal object. One type of sharpening wheel which has a motor driven vertically mounted grinding wheel provided with a stream of water re-circulated to cool the wheel is shown in my prior U.S. Pat. No. 4,388,780 assigned to Wen Products, Inc., the assignee of this invention.

My prior invention used the flat surface of a vertically mounted wheel for the sharpening and a mechanical pump was used to keep the grinding wheel moist. Since the flat surface of the grinding wheel was utilized, the device could not be used in a hollow grinding mode.

SUMMARY OF THE INVENTION

The present invention provides an improvement over the existing art in several features.

Specifically, the present invention replaces the electrically powered mechanical pump with a pump means operated by wicking action. An absorbent, but relatively hard material such as hard felt is positioned with one end submerged in a reservoir and a second end in contact with a horizontally mounted rotating grinding wheel. By wicking action, water is drawn up and dispensed onto the wheel as it rotates in contact with the wick. The wick also functions as a device for removing the "swarf" which is the grinding residue left on the grinding wheel. The grinding wheel has a highly porous quality which gives it a characteristic of holding a large supply of water. When the wheel spins, the water tends to move by centrifugal force to the surface of the wheel. Excess water is flung from the wheel within the housing and is channeled back to the reservoir for reuse.

A second feature of the present invention is that a tool rest provided on the machine has a "phantom pivot point", that is, the pivot is provided by a threaded knob captured in a V-shaped slot which has an upper leg and a lower leg. Calibration points are molded directly into the side of the housing visible to the user. Thus, when an arrowhead located on the tool rest is placed on a specific point, then a UL specifed clearance of 1/16 of an inch between the tool rest and the grinding wheel is ensured. The upper and lower legs of the V-shaped slot permit the user to exploit different quadrants of the grinding wheel. When the upper leg of the V is used to create the phantom pivot point, the tool rest surface will be positioned on the lower quadrant of the wheel. Selected angles can be achieved by positioning the arrowhead on the side of the tool rest adjacent to the appropriate markings on the housing of the body. When the lower leg of the V is used to control the positioning of the phantom pivot point, the tool rest surface will then be in the upper quadrant of the wheel. This is advantageous when sharpening tools such as knives since it places the knife edge in a very accessible location and allows the operator to push the blade down against the wheel surface. The standard tool rest is also provided with a recess on each lateral side of the tool rest surface so that the handle of a knife can be readily accomodated.

Another feature of the present invention is the provision of a special scissors blade guide. The scissors guide is positioned just above the horizontally mounted wheel and is constructed and arranged to support a scissors blade with a back rake angle of 2°. On the right hand side of the machine, there is a scissors blade ramp which extends downwardly and which affords a recessed area in which the extended opposite blade of the scissors, the one not being sharpened, can extend. By virtue of such arrangement, the operator can go all the way to the hilt of the blade for full blade sharpening.

Another feature of the invention is the provision of a tool guide protractor which can be moveably mounted on the tool rest surface. The tool rest has three pivot holes in longitudinally spaced relationship to allow the protractor to be shifted between positions for sharpening both sides of a tool cutting edge. A slot and screw fastener is also provided to lock the protractor in adjusted angular positions.

Another feature of the present invention is the provision of a retaining leg pivotable between a storage position and a use position. In the use position, the retaining leg lies over the front edge of a supporting surface to lock the machine in place to prevent it from walking during heavy grinding.

Other features of the present invention include the provision of varying tool rests to accomodate oversized or specially shaped tools. The entire device results in a compact horizontally mounted grinding wheel capable of sharpening, grinding and honing a variety of tools and yet being quite portable.

DESCRIPTION OF THE PREFERRED EMBODIMENTS

Figure 1:
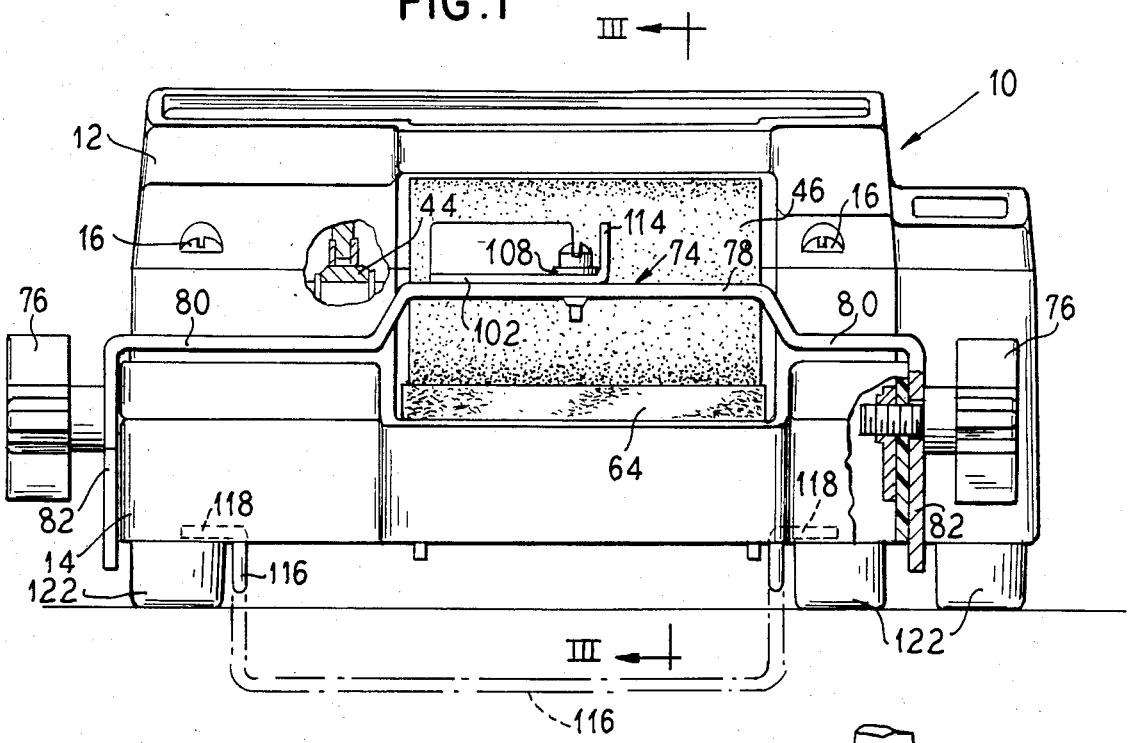
FIG. 1 is a front elevational view of a grinding, honing and sharpening machine emboding the principles of the present invention.

In FIG. 1 there is shown generally at 10 a combined hollow grinder, sharpener and honer emboding the principles of the present invention. The device is enclosed in a two-piece housing comprising a top housing 12 and a bottom housing 14 which are secured together by appropriate fastening means such as screws 16.

Mounted within the housings 12, 14 is an electric motor 18 powered through an electric cord 20. An on-off switch 22 is accessible on the top housing 12 to permit the user to selectively energize the motor 18. The switch 22 is positioned within a recessed cavity 24 to prevent accidental energizing of the motor 18.

The motor 18 has an extending shaft 26 carrying a rotatable fan 28 for cooling the motor and passing through an intermediate spherical bearing 30. The shaft 26 carries on an end thereof a drive gear 32. The drive gear 32 meshes with and drives an intermediate reducing gear 34 which is journaled in bearings 36 captured in the lower housing 14. A reduced portion 38 of the reducing gear 34 meshes with and drives a gear 40 carried on a shaft 42 which is journaled in spherical bearings 44 and which carries a cylindrical grinding wheel 46 in a horizontal orientation.

The sharpening wheel has a highly porous quality and can be fabricated of a material such as vitrified bonded aluminum oxide. It has been found that a 180 grit grinding wheel performs satisfactorily in most grinding, sharpening and honing operations.

Figure 3:
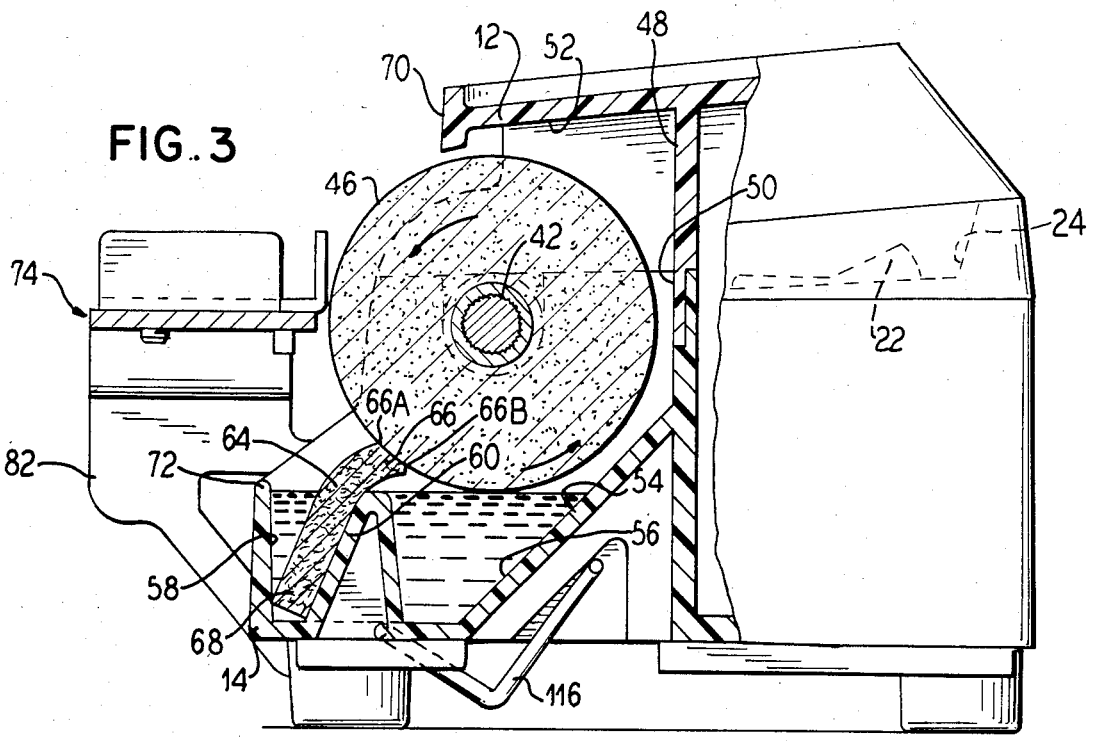
FIG. 3 is a side sectional view taken generally along the lines III—III of FIG. 1.
Figure 4:
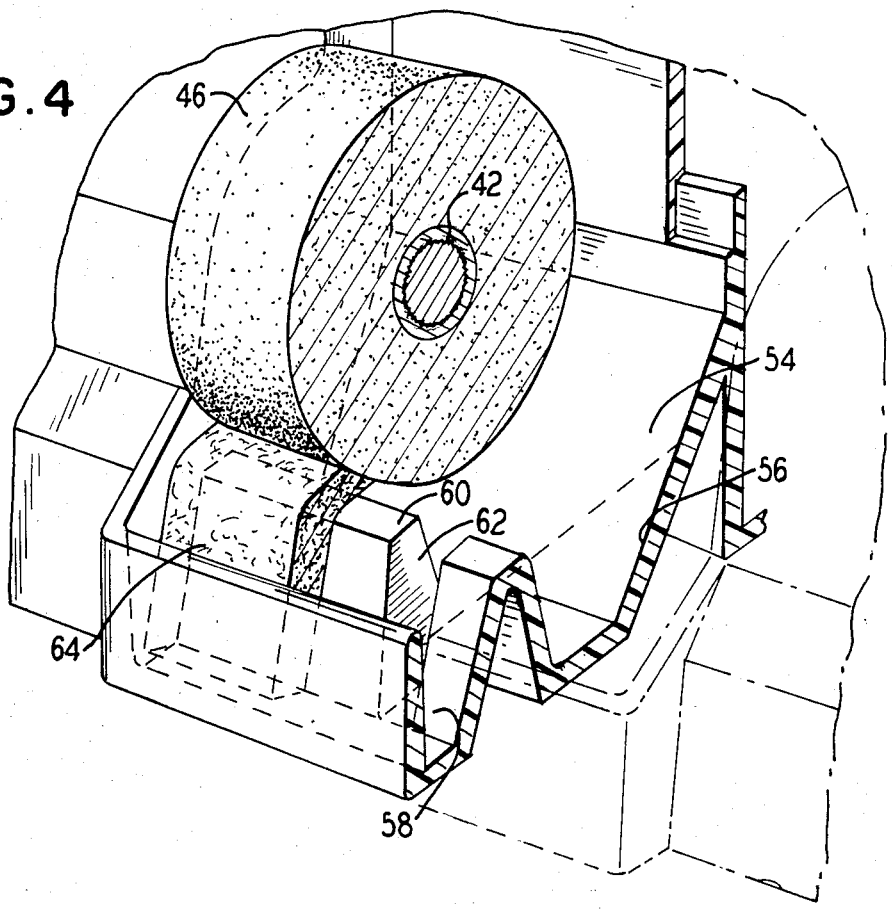
FIG. 4 is a partial prospective view of the wheel and reservoir portion of the device.

As seen in greater detail in FIGS. 3 and 4, the grinding wheel 46 is carried on its shaft 42 in a horizontal orientation within a chamber 48 formed within the housings 12, 14. An upper portion of the chamber forms a rear wall 50 and top wall 52. A lower portion comprises a reservoir 54 for holding a lubricating or cooling liquid such as water. The reservoir 54 has a rear cavity 56 and a front cavity 58 separated by a rib 60. A channel 62 connects the rear cavity 56 and the front cavity 58 to permit fluid communication therebetween.

A wiper 64 is positioned in the front cavity 58 and is held against an angled wall of the rib 60 such that a top end 66 of the wiper is in contact with the rotating grinding wheel 46. A bottom end 68 of the wiper 64 is captured in the bottom of the front cavity 58 such that the wiper is submerged in the cooling liquid. The wiper is a highly porous material such as felt and it has been determined that a SAE F3 felt is a mechanical relatively hard felt which has good wear resistance in this application and which can be positioned against the grinding wheel as it rotates. The felt acts as a wick to draw the liquid up onto the rotating wheel 46 thereby obviating the need for a mechanical pump to dispense liquid on the grinding wheel.

As the grinding wheel rotates, the liquid is caused to move to the surface of the wheel by centrifical force and any excess liquid is flung from the wheel against the rear or top walls 50, 52 of the chamber 48 rather than into to the room where the operator is working. The excess liquid then drains back into the rear chamber 56 and through the channel 62 to be drawn upwardly by the wiper 64.

During a grinding, sharpening or honing operation, grinding residue called "swarf" forms on the exterior surface of the grinding wheel. However, as the grinding wheel rotates against the wiper 64, the leading edge of the wiper tends to wipe off the wheel surface and the swarf is removed from the wheel and accumulates on the leading edge 66A of the wiper 64. The trailing edge of the felt re-wets the cleaned surface of the wheel and conditions the wheel for further contact with the workpiece.

The top wall 52 of the upper housing 12 terminates in a forward position with a short nearly vertical wall 70 positioned above the top surface of the grinding wheel 46. The front wall of the front reservoir cavity 58 terminates at a top end 72 approximately level with the lower most portion of the grinding wheel 46 thus exposing a large area of the grinding wheel towards the front of the device. Water or other liquid may be poured directly into the reservoir 54 from the front of the machine.

Figure 2:
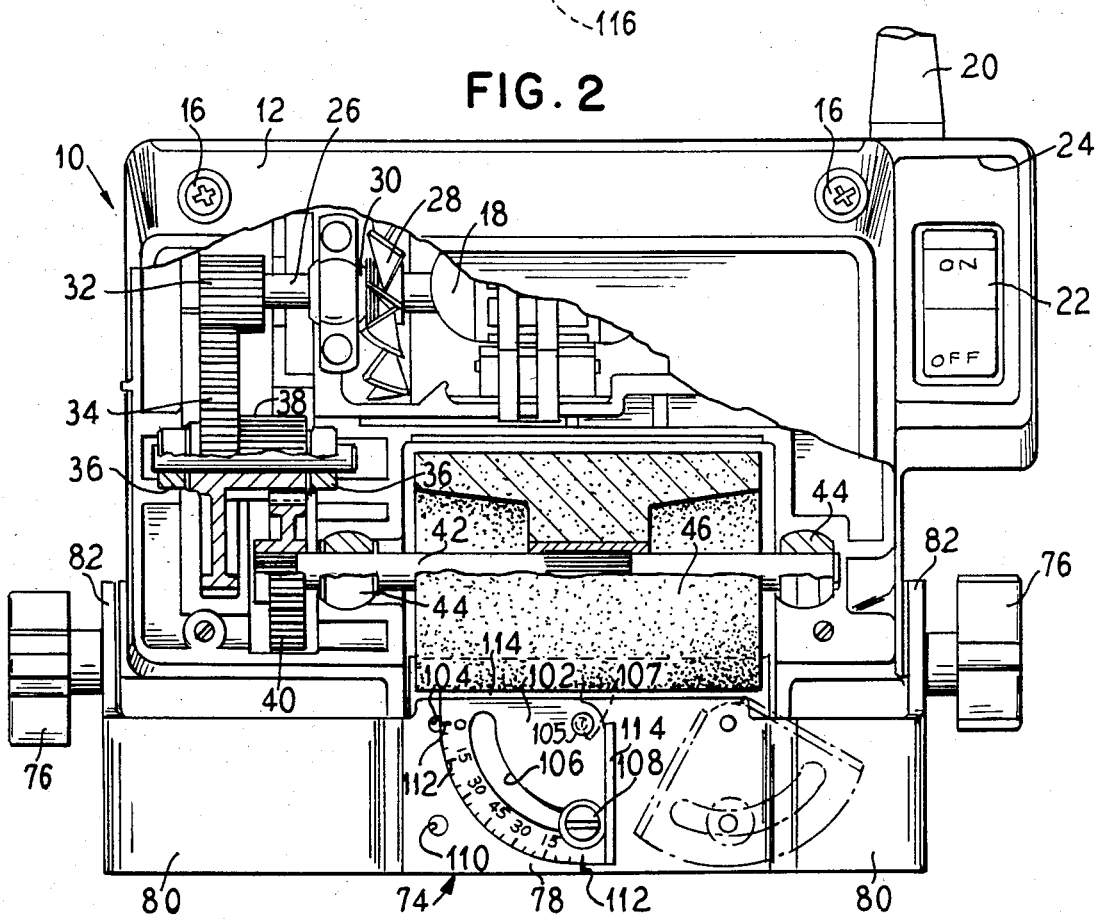
FIG. 2 is a plan view of the device shown in FIG. 1 partially cutaway to show the interior thereof.

To assist in accurately positioning a tool against the grinding wheel to be sharpened, there is provided a tool support 74 which extends across the entire front of the device 10 and is secured at either side by a threaded knob 76. As seen in FIGS. 1 and 2, the tool support 74 comprises a plate like member having an elevated area 78 extending along the length of the rotating wheel 46 and which is joined to lower, horizontal portions 80 which extend to the sides and are connected to vertical portions 82 through which the threaded knobs 76 pass. The offset of the horizontal portions 78, 80 is provided to allow for clearance for tools having an enlarged handle area such as knives. Thus, the blade portion of the tool can be positioned on the upper horizontal portion 78 and the handle can be received adjacent to the lower horizontal area 80.

Figure 5:
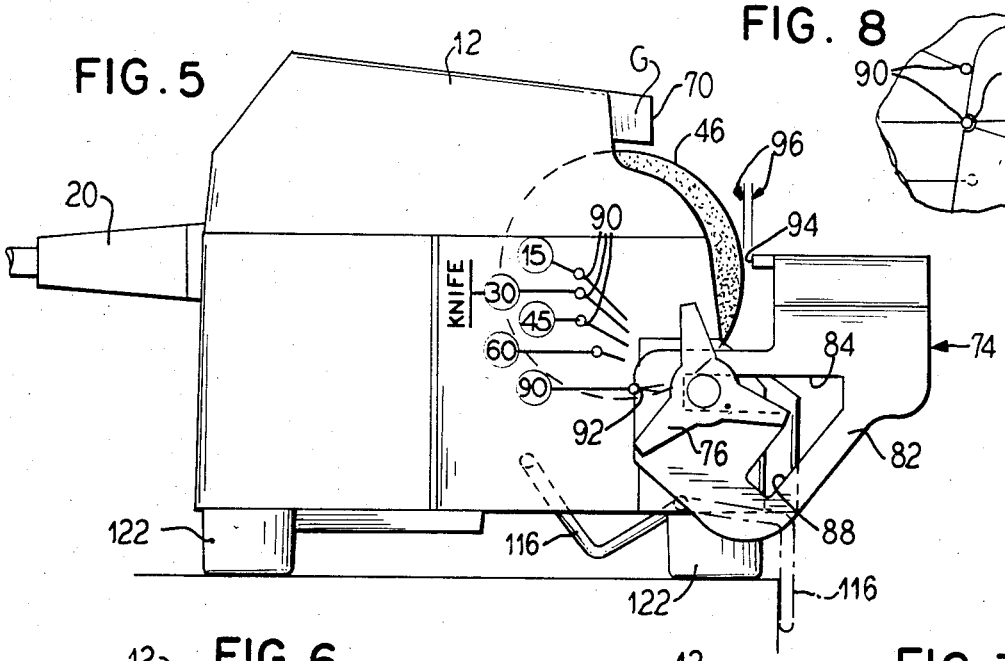
FIG. 5 is a side elevational view showing the tool rest adjustment means.
Figure 6:
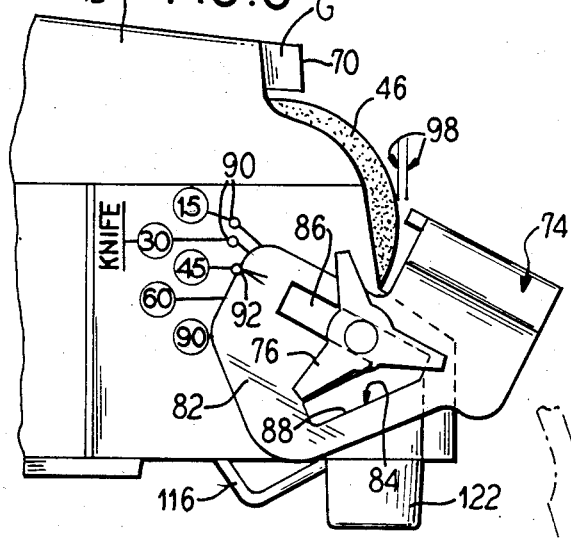
FIG. 6 is a partial side elevational view showing the tool rest pivoted at a specific angle utilizing the top leg of the V-shaped slot.
Figure 7:
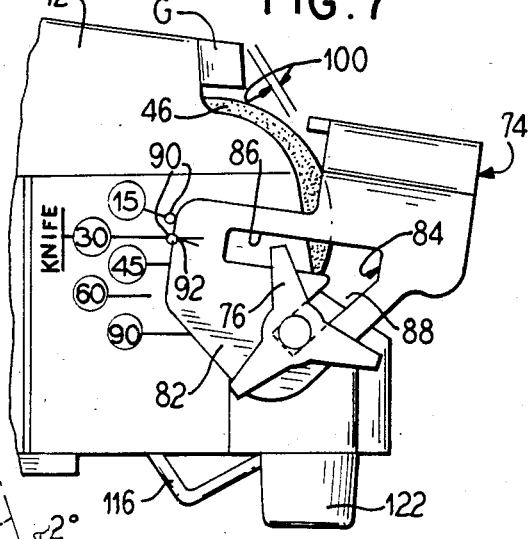
FIG. 7 is a side elevational view showing the tool support in a specific angular position utilizing the lower leg of the V-shaped slot.

The flat upper surface of the tool rest 74 can be pivoted relative to the grinding wheel 46 to allow for a wide range of vertical angular positions of the surface relative to the working area on the grinding wheel. To enhance the adjustability of the support surface, the vertical end portions 82 of the tool rest 74 are provided with a V-shaped slot 84 as best seen in FIGS. 5–7. The use of such a slot 84 provides a "phantom" pivot point and allows for adjustability of the support surface through a wide range of angular and lateral positions.

Figure 8:
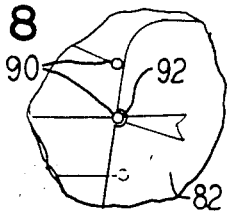
FIG. 8 is an enlarged detail view of the alignment pointer area on the tool support.

The V-shaped slot 84 is positioned such that the V is laying on its side, thus having an upper leg portion 86 and a lower leg portion 88. The upper leg portion 86 is oriented substantially parallel to the flat support surface of the work support 74. The lower leg 88 is angled downwardly away from the support surface. The side of the housing 12, 14 has a plurality of markings 90 thereon corresponding to various angles. Small reference dots are identified with indicia markings signifying specific angles. The vertical arm 82 of the tool support 74 is provided with a small notch and pointer arrow 92 as is best seen in FIG. 8 which can be aligned with a selected marking 90 to present the support surface of the tool support 74 in a specific angular and spacial relationship to the grinding wheel 46.

Specifically, as is seen in FIG. 5, the pointer 92 is positioned such that a dot associated with the 90° marking is positioned within the notch adjacent the pointer arrow. In such a position, the support surface of the tool support 74 is oriented at 90° relative to the grinding wheel 46 and a rear edge 94 thereof is positioned at a distance shown at arrow 96 which is the minimum safe operating gap as defined by UL Laboratories. This gap provides a clearance of 1/16 of an inch. Thus, positioning the notch 92 at the marking dot 90 provides not only an angular relationship but also a spacial relationship relative to the grinding wheel 46.

As seen in FIG. 6, the tool support 74 is rotated and the threaded knob 76 is positioned in the upper leg 86 of the slot so that the notch 92 is positioned adjacent a marking designating 45°. As seen, the support surface of the tool support 74 is positioned at a 45° angle relative to the grinding wheel 46 and the gap shown at arrows 98 again provides a clearance of 1/16 of an inch.

As seen in FIG. 7, the tool support 74 is rotated such that the knob 76 is received in the lower leg 88 of the notch 84 and the pointer notch 92 is positioned adjacent a marking designating 30°. This marking is also identified with the designation "knife" meaning that this position is useful in sharpening knives. As can be seen in the figure, the support surface of the tool support 74 is positioned at about an 8½° angle relative to the rotating wheel 46 and again a gap shown at 100 is presented which provides a clearance of 1/16 of an inch. In this position, the knife edge will be presented against an upper quadrant of the wheel 46 which is advantageous since the knife edge is then in a very accessible location and allows the operator to push the blade down against the wheel surface. Thus, the tool support 74 provides for vertical angular adjustability of the tool edge relative to the grinding wheel.

In order to provide precision in selecting a horizontal angle in sharpening the tool blade, a pivotable protractor 102 is movably secureable to the support surface of the tool support 74 and can be placed in a plurality of longitidinal positions relative to the cylinder: cal wheel axis, as well as being pivotable through 90° in each longitudinal position. The protractor, best seen in FIGS. 1 and 2, is a generally triangular shaped plate with an aperture 104 near the vertex of two converging legs which is to receive a removable retaining means such as a pin 105 which is utilized to removably position the protractor 102 over one of a plurality of openings 107 in the tool support 74. An arcuate slot 106 is provided in the plate 102 having the aperture 104 being the center point of the radius of the slot. A removable fastening means such as a screw 108 is receivable in the slot and in one of a plurality of openings 110 in the tool support 74 to selectively lock the protractor in a desired angular relationship to the support plate.

Markings 112 comprising an angular scale are positioned adjacent the arcuate slot 106 and a reference mark 112 on the support plate 74 is used to precisely position the plate 102 relative to the support 74. The protractor plate 102 has a pair of upstanding walls 114 extending along the converging side legs of the plate. These upstanding walls 114 form stops against which the tool may be rested so that the tool can be accurately guided toward the grinding wheel at the desired angle. With the provision of multiple placement points as well as 90° rotatability of the protractor plate 102, both sides of a tool may be sharpened with the assistance of the protractor. A second protractor position is shown in phantom in FIG. 2. Thus, with the horizontal angular adjustability provided by the protractor and the vertical angular adjustability provided by the tool support, virtually any desired angle can be precisely attained for sharpening of a tool.

Figure 9:
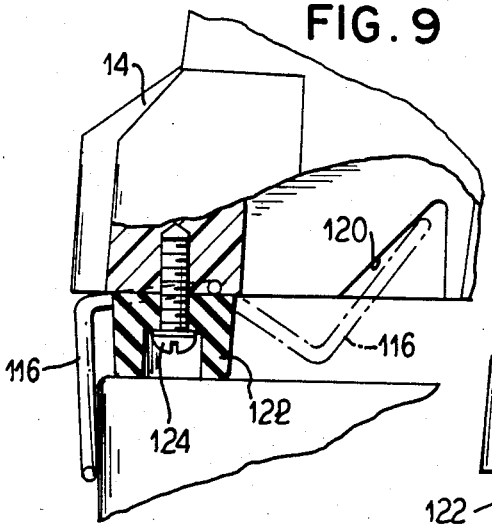
FIG. 9 is a partial sectional view showing the pivotability of the retaining leg.

Because the grinding device emboding the principles of the present invention can be made very compact and light weight, a selectively pivotable retaining leg 116 is provided which can be utilized, as seen in FIGS. 5 and 9, to hold the device in a stationary position relative to a table top or other work surface. As seen in FIG. 1, ends 118 of the retaining leg 116 are pivotally received in the lower housing 14 and allow the retaining leg to pivot forwardly and rearwardly. As best seen in FIG. 9, a recess 120 is provided in a bottom wall of the lower bottom housing 14 so that the retaining leg may be pivoted into a recessed position to provide clearance at the bottom of the device. Thus, when the retaining leg is not being used it may be folded out of the way.

Four rubber feet 122 are removably secured to the bottom wall of the lower housing 14 by appropriate fastening means such as screws 124. The rubber feet provide sufficient friction to prevent the device from sliding on the work surface.

Figure 10:
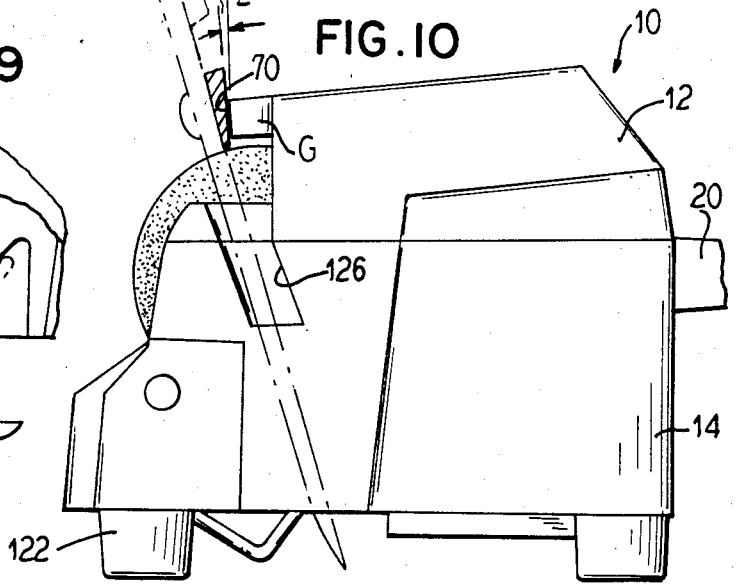
FIG. 10 is a side elevational view with a scissors being sharpened.
Figure 11:
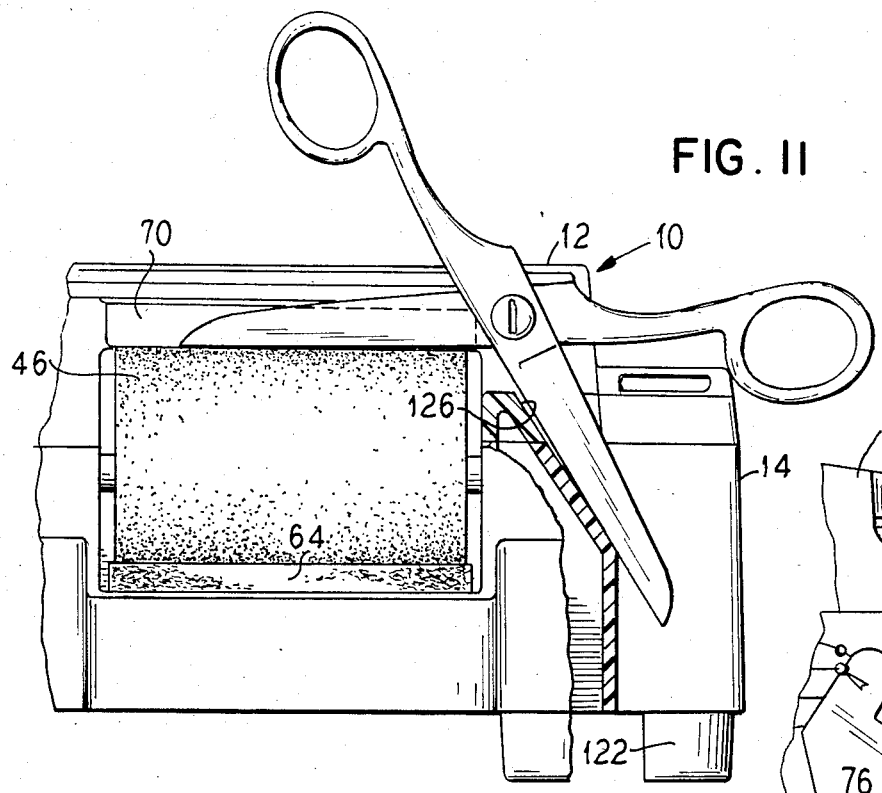
FIG. 11 is a partial front view showing a scissors being sharpened.

Another feature of the present invention is the provision of a scissors blade guide to assist in the sharpening of scissors. The front wall 70 of the upper housing 17 is oriented at a slight displacement from vertical to support and guide a scissors blade with a back rake angle of 2°. This is best seen in FIG. 10. On the right hand side of the machine, there is a scissors blade ramp 126 which extends downwardly and which affords a recessed area in which the extended opposite blade of the scissors, the one not being sharpened, can extend. With the provision of the blade ramp 126, each scissors blade can be sharpened all the way to the pivot connection of the two blades. The wall 70 thus provides a guide and support to ensure proper alignment of the scissors during sharpening.

Figure 13:
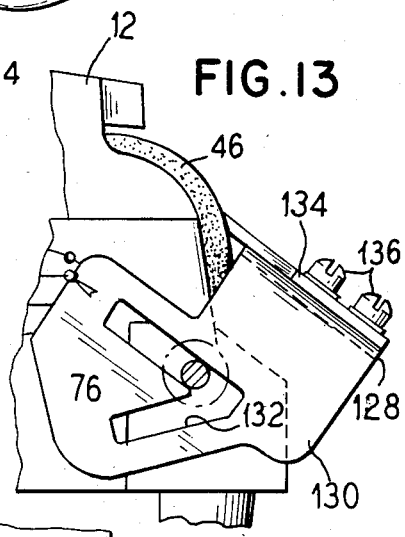
FIG. 13 is a partial side elevational view taken generally along the lines XIII—XIII of FIG. 12.
Figure 12:
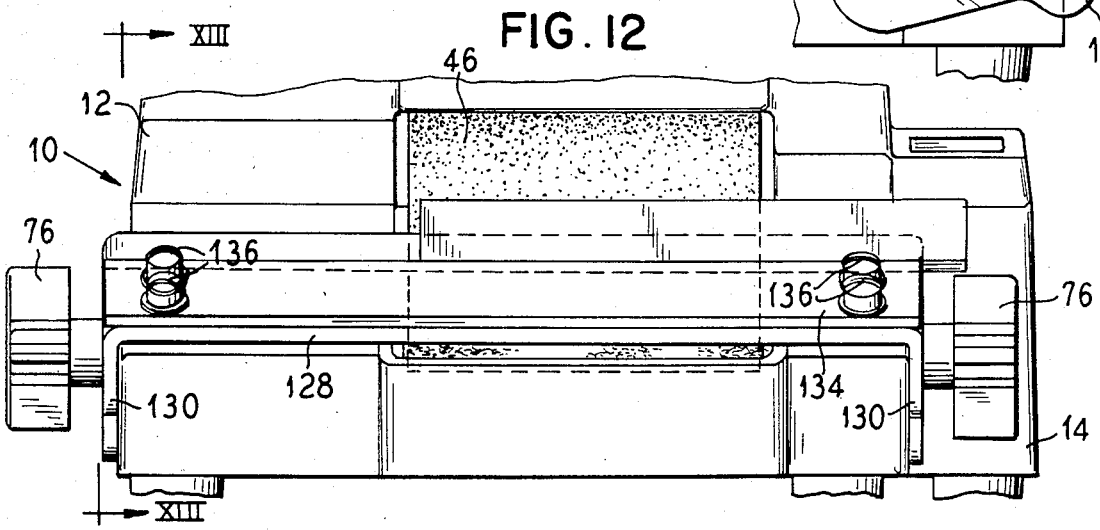
FIG. 12 is a partial front elevational view showing the use an alternative tool rest.
Figure 14:
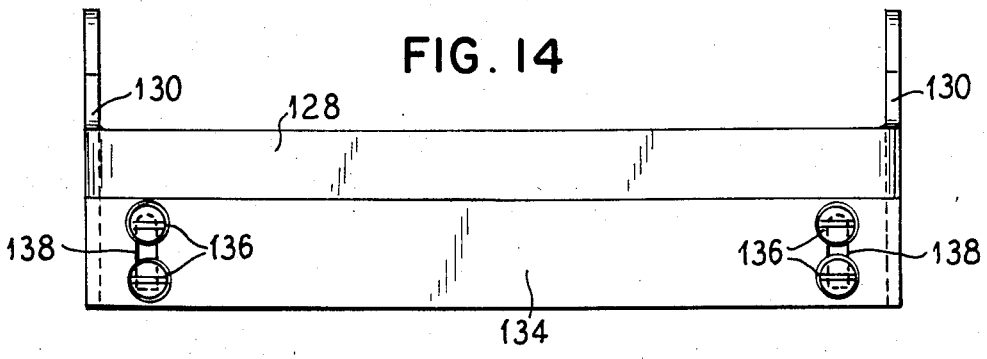
FIG. 14 is a plan view of the alternate tool rest of FIG. 12.

In FIGS. 12–14 there is shown an alternative embodiment of the tool support which comprises a planar plate number 128 extending across the width of the device and having end wall portions 130 formed at right angles to the planar portion. The side walls 130 are substantially identical to the walls 82 described above and have a V-notch 132 formed therein which can be used in a manner identical to that described above with respect to notch 84. The planar plate portion is similar to portion 78 of the tool rest described above with the difference that it extends across the entire width rather than having a portion, such as portion 80 at a lower level to accommodate tool handles. Rather, planar portion 128 extends across the entire width of the machine and provides an elongated flat surface. A stop member 134 comprising a second planar plate member is positioned on the upper surface of the planar portion 128 and is moveably retained thereon by appropriate fastening means such as screws 136 positioned at either end of the plate 134. The fastening means 136 are received in slots 138 so that the entire stop member 134 may be moved closer to or farther from the grinding wheel 46 on the tool support. In this manner, a long blade, such as shown is FIGS. 12 and 13 can be supported along it length to ensure the accuracy of a straight grinding operation. Thus, linearity of the sharpened edge of the tool is maintained.

As is apparent from the foregoing specification, the invention is susceptible of being embodied with various alterations and modifications which may differ particularly from those that hae been described in the preceeding specification and description. It should be understood that I wish to embody within the scope of the patent warranted hereon all such modifications as reasonably and properly come within the scope of my contribution to the art.

I claim as my invention:

1. An electric grinder comprising:

a housing;

a horizontally mounted cylindrically shaped grinding wheel rotatably mounted in said housing; motor means for drivingly rotating said wheel; and a tool rest member having a tool support surface pivotally and laterally movable relative to said wheel and mounting means for mounting the member on the housing forming a phantom pivot point for the member;

said mounting means comprising a V-shaped slot in said member capturing a fixed pivot pin means on said housing; whereby, the member is pivotable about said fixed pivot pin means and is laterally movable by sliding said slot relative to said fixed pivot pin means.

2. The device of claim 1 wherein said tool rest member is selectively lockable in a plurality of angular positions relative to said wheel.

3. The device of claim 2 including indicia markings on said housing and said tool rest member to permit accurate positioning of said tool rest relative to said wheel.

4. An electric grinder according to claim 1 wherein said grinding wheel is porous and including a reservoir formed in said housing for holding a supply of liquid, means extending between said reservoir and said wheel for applying said liquid onto said wheel; and means for collecting excess liquid from said wheel and returning it to said reservoir.

5. The device of claim 4 wherein said means for applying liquid to said wheel comprises a porous wiper partially submerged in said reservoir and extending into contact with said wheel.

6. The device of claim 5 wherein said reservoir is comprised of two chambers separated by an upstanding rib and connected by a channel through said rib.

7. The device of claim 6 wherein said rib supports and positions said wiper into aligned engagement with said wheel said wiper having a wheel engaging end formed with a leading edge to wipe swarf from the wheel and a trailing edge to rewet the wheel.

8. The device of claim 4 including means for removing swarf from said wheel during a grinding operation.

9. The device of claim 4, further comprising a scissors blade support surface on said housing adjacent to said wheel to support and align a scissors blade at a fixed sharpening angle relative to said wheel; and a recess in said housing to receive a second scissors blade of a pair being sharpened, whereby the entire length of each blade may be sharpened.

10. The device of claim 4, further comprising a tool rest member having a tool support surface pivotally movable relative to said wheel; and a tool stop member movably mounted on said tool rest member to hold a tool in fixed relationship to said tool rest member.

11. The device of claim 4, further comprising a tool support member against which a tool may be positioned to engage said wheel; and a tool guide protractor member movably securable to said tool support member and pivotable with respect thereto; whereby various angular positions of said tool relative to said wheel may be selected.

12. The device of claim 4, further comprising a lower portion of said housing being engagable with a horizontally disposed work surface and a retaining means having offset positions pivotally movable into and out of an operative position engagable with a vertical edge of said work surface to retain said grinder in position, and recess means in said housing receiving said retaining means when out of said operative position and pivoted to a position clear of said work surface.

13. An electric grinder according to claim 1 including a scissors blade support surface on said housing adjacent to said wheel to support and align a scissors blade at a fixed sharpening angle relative to said wheel and a recess in said housing to receive a second scissors blade of a pair being sharpened, whereby, the entire length of each blade may be sharpened.

14. An electric grinder according to claim 1 including a tool stop member movably mounted on said tool rest member to hold a tool in a fixed relationship to said tool rest member.

15. The device of claim 14 wherein said tool stop member includes means for aligning said stop member parallel to a grinding surface on said grinding wheel.

16. The device of claim 15 wherein said tool stop member has a plurality of parallel slots therein to each receive a plurality of removable fastening means whereby the position of said stop member may be adjusted, yet its orientation will be maintained.

17. An electric grinder according to claim 1 including a tool guide protractor member movably securable to said tool support member and pivotable with respect thereto, whereby various angular positions of said tool relative to said wheel may be selected.

18. The device of claim 17 wherein said tool guide protractor is pivotable through a range of at least 90°.

19. The device of claim 17 wherein said tool guide protractor is selectively movable between a plurality of positions on said tool support member.

20. The device of claim 17 wherein said tool guide protractor has upstanding walls against which said tool may be placed.

21. An electric grinder according to claim 1 wherein said housing has a lower portion engagble with a horizontally disposed work surface and including a retaining means having offset positions pivotally movable into and out of operative position, said retaining means when in said operative position being engagable with a vertical edge of said work surface to retain said grinder in position, and recess means in said housing receiving said retaining means when out of said operative position and pivoted to a position clear of said work surface.

22. The device of claim 21 wherein said retaining means comprises a pivotable leg which is pivotable out of said operative position into a recess in said housing.

* * * * *